US005242559A

United States Patent [19]

Giorgi

[11] Patent Number: 5,242,559

[45] Date of Patent: Sep. 7, 1993

[54] METHOD FOR THE MANUFACTURE OF POROUS NON-EVAPORABLE GETTER DEVICES AND GETTER DEVICES SO PRODUCED

[75] Inventor: Ettore Giorgi, Milan, Italy

[73] Assignee: Getters SpA, Milan, Italy

[21] Appl. No.: 709,644

[22] Filed: Mar. 8, 1985

[30] Foreign Application Priority Data

Mar. 16, 1984 [IT] Italy ..... 20097A/84

[51] Int. Cl.[5] ..... C25D 13/00

[52] U.S. Cl. ..... 204/181.4; 204/181.5; 252/181.1; 252/181.6

[58] Field of Search ..... 204/181.4, 181.5, 181.7; 156/66; 252/181.6, 181.1

[56] References Cited

U.S. PATENT DOCUMENTS 4,360,445 11/1982 Mendelsohn et al. ..... 252/181.6
4,428,856 1/1984 Boyarina et al. ..... 252/181.1

FOREIGN PATENT DOCUMENTS 281245 11/1865 Australia ..... 204/181.5
781592 3/1968 Canada ..... 204/181.5
48523 4/1977 Japan ..... 204/181.5

*Primary Examiner*—Nam X. Nguyen
*Attorney, Agent, or Firm*—David R. Murphy

[57] ABSTRACT

A method is described for the electrophoretic deposition, in the form of a porous coating, of at least one getter material and simultaneously an antisintering agent on any form of support.

The getter material may be a powder of a metal, of a metal alloy or of a hydride thereof, or a mixture of these components. The getter material powders have a particle size less than 100 μ and an average particle size less than 60 μ but preferably greater than about 20 μ. The antisintering agent has a particle size of the same order of magnitude. After a heat treatment under vacuum the getter devices produced have an open porous structure and have good gas sorption properties. The support for the getter material can be graphite or a metal or a metal coated with ceramic.

4 Claims, 3 Drawing Sheets

METHOD FOR THE MANUFACTURE OF POROUS NON-EVAPORABLE GETTER DEVICES AND GETTER DEVICES SO PRODUCED

Non-evaporable getter devices are well known in the art. They are used to remove unwanted gases from evacuated or rare gas filled vessels such as electron tubes. They can also be used to remove gases selectively from an atmosphere such as nitrogen within the jacket of high intensity discharge lamps. Many different materials have been proposed for use as non-evaporable getters. For example Della Porta in U.S. Pat. No. 3,203,901 describes the use of a Zr-Al alloy and especially an alloy containing 84% wt Zr, remainder Al. UK Patent Number 1,533,487 describes the gettering composition $Zr_2Ni$. Zr-Fe alloys containing from 15% to 30% wt of Fe, balance Zr, have been described in U.S. Pat. No. 4,306,887. Ternary alloys have also been described such as Zr-Ti-Fe and Zr-$M_1$-$M_2$ in which $M_1$ is a metal chosen from the group consisting of vanadium and niobium and in which $M_2$ is a metal chosen from the group consisting of iron and nickel. Gettering compositions based on titanium are also known (see for example U.S. Pat. No. 4,428,856). These getter materials are normally used in the form of a finely divided powder having a particle size generally less than about 125 $\mu$. The powdered getter material can be compressed so as to form a pill or self-supporting tablet, or the getter material can be pressed into a ring-shaped container having a u-shaped cross-section. Such getter devices can be relatively large and have the disadvantage that usually only the outer layers of the powder getter material are able to sorb gas, while the inner particles do not contribute to the gas sorption process and are a waste of costly getter material.

To try and overcome the disadvantages of the use of getter materials in the form of pills or compressed tablets, or their use in ring containers, della Porta et al in U.S. Pat. No. 3,652,317 have described a method of mechanically manufacturing a substrate having a coating of getter material particles with a high surface area to mass ratio. However this method, even if it provides a considerable saving of getter material, is very complex and requires the use of expensive machinery.

It is also difficult to control the thickness of the coating formed, with the consequence that the getter device does not have uniform characteristics.

This mechanical method of coating a substrate with particles can only be used if the particles are much harder than the substrate. If the particles are only slightly harder, or are even softer than the substrate, then during the mechanical coating process they tend to undergo plastic deformation and weld to each other. As a consequence the coating has a low surface area to mass ratio with poor adhesion to the substrate. Della Porta et al in U.S. Pat. Nos. 3,856,709 and 3,975,304 suggest the addition of hard particles to the soft particles to obtain a coating of soft particles on the substrate with a high surface area to mass ratio. However this method of coating still requires the use of costly machinery and it is still difficult to control the thickness of the coating produced.

Neither of the latter two methods proposed is able to give a satisfactory coating on a substrate which has a thickness comparable to that of the coating or less than that thickness due to penetration of the particles which provoke excessive deformation of the substrate and even its complete penetration. Furthermore the particles are not firmly attached to the substrate. It is also difficult or impossible to use these methods for coating anything other than a long continuous strip of support material. In no case is it possible to coat the strip if it is too hard.

In order to manufacture getter devices having a high porosity, such that a significant amount of the getter material within the body of the device is able to sorb gas, Wintzer has proposed in U.S. Pat. No. 3,584,253, the use of Zr powder intimately mixed with powdered graphite as an antisintering agent so as to maintain a large surface of the gas sorbing material. It has been found that such a composite gettering material has the ability to sorb gas even at room temperature. U.S. Pat. No. 3,926,832 (Barosi) and UK Patent Application Number 2,077,487 A filed in the name of the present applicant, describe other porous getter materials in which the antisintering agent comprises a Zr-based getter alloy.

Unfortunately the industrial scale production of such porous non-evaporable getter devices is lengthy and requires much labour. One technique used for the preparation of getter devices using the composite getter material is that of preparing a viscous suspension of the composite material in an organic liquid and then individually painting the supports with this suspension. However it is very difficult or impossible to control the amount of getter material applied to each support. The use of flammable organic liquids, which may also be toxic, is a risk for the personnel and furthermore, even with the painting technique it may be difficult or impossible to cover some shapes of getter materials support. An alternative technique is that of using a mould into which the composite getter material mixture is poured. However, this requires an individual mould for each getter device and is therefore again a costly technique which requires excessive time. W. Espe in the book "Zirkonium, Seine Herstellung, Eigenschaften and Anwendungen in der Vakuumtechnik", C. F. Winter'sche Verlagshandlung, Fussen/Bayern, 1953, describes a process for the deposition of Zr and Zr hydride by means of electrophoresis, but the coating obtained has a low porosity.

It is therefore an object of the present invention to provide a method for the manufacture of non-evaporable getter devices which are substantially free from one or more disadvantages of the prior methods.

It is another object of the present invention to provide a method for the manufacture of non-evaporable getter devices which avoids the use of excessive amounts of getter material.

It is yet another object of the present invention to provide a method for the manufacture of non-evaporable getter devices without the use of costly or complicated production equipment.

It is a further object of the present invention to provide a method for the manufacture of getter devices which is suitable for mass production and requires a minimum number of personnel with minimum risk to the personnel.

Another object of the present invention is to provide a method for manufacturing of non-evaporable getter devices having more reproducible mechanical and gas sorption characteristics.

Yet another object of the present invention is to provide a method for the manufacture of non-evaporable getter devices which have practically any shape and size of support.

Further objects and advantages of the present invention will become evident with reference to the following description and drawings wherein:

Figure 1:
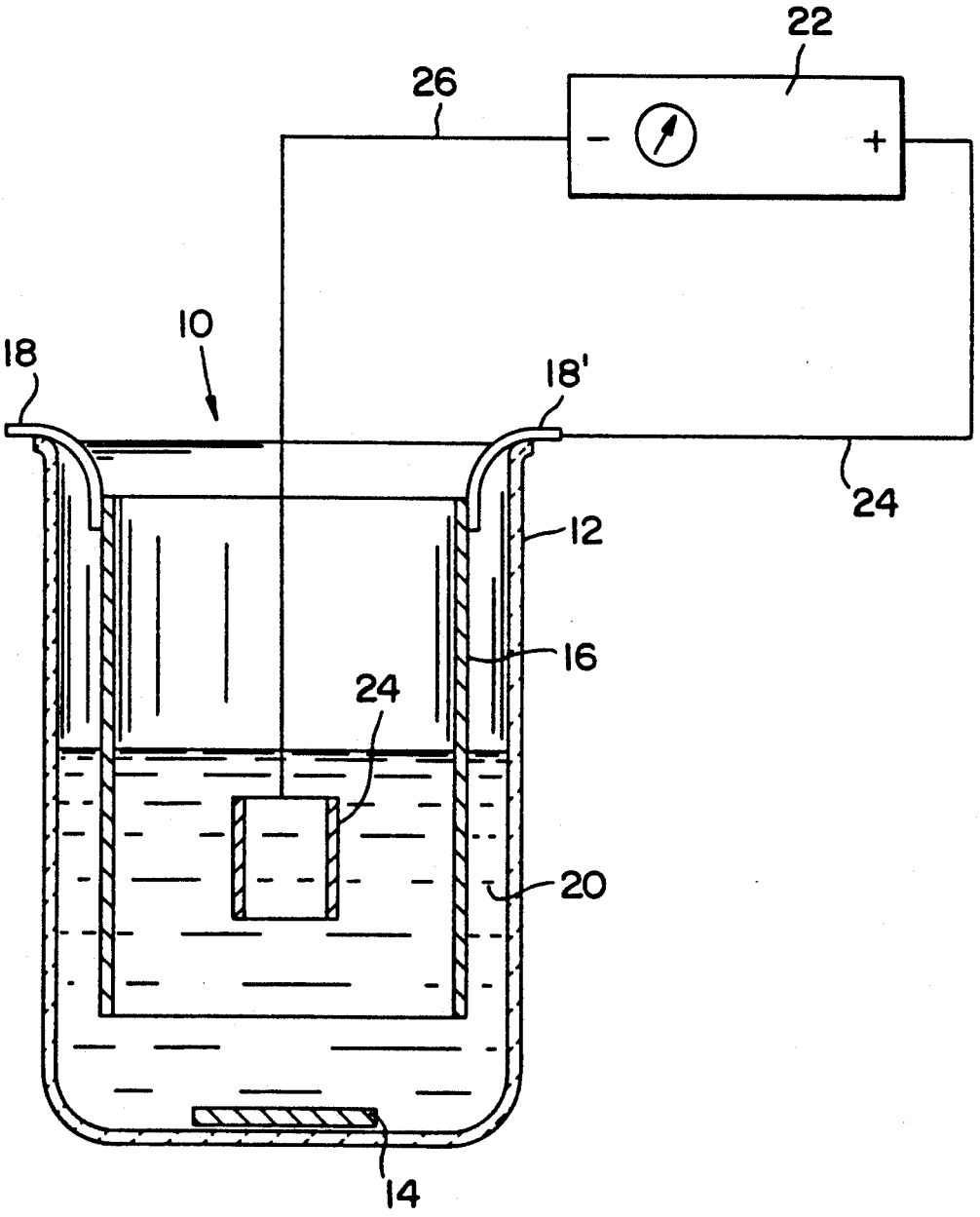
FIG. 1 is a cross-sectional re-presentation of an experimental apparatus for the production of non-evaporable getter devices according to the present invention.

The present invention provides a method for the manufacture of a getter device by means of the electrophoretic deposition of at least one powdered getter material simultaneously with a powdered antisintering agent on a support having any desired form. For example it may be in the form of a metal wire of any desired diameter. The wire may be straight or it could be bent into any desired shape such as, for example, a spiral or a fibilar winding for use as a heater in the getter device itself. The wire may previously have been coated with an insulating material such as alumina. The support could also, for instance, be in the form of a strip or ribbon of metal such as stainless steel or iron or nickel plated iron. Alternatively it may be of a high electrical resistance metal such as nichrome or it may be graphite. The strip may be bent into any desired shape prior to depositing electrophoretically the getter material and antisintering agent coating such as a cylinder or a zigzag or concertina fashion. Whatever the shape of the getter support it is coated electrophoretically by immersion in a suspension of particles of at least one getter material and an antisintering agent in a liquid. Between the getter support, which acts as a first electrode, and a second electrode there is passed direct electric current which causes the deposition of powdered getter material and antisintering agent which coats the getter support. This support and its coating are then removed from the suspension and allowed to dry. The coated support is then placed in a vacuum oven in which there is maintained a pressure less than about $10^{-3}$ Torr ($10^{-1}$ Pa) and heated to a temperature less than about 1100° C. The getter with its support is then allowed to cool down to room temperature whereupon it is removed from the vacuum oven and is ready for use. The getter device exhibits no loose particles and has a high resistance to mechanical compression, vibration and shock.

A getter device produced in this way is particularly suitable for use when high sorption speeds are required such as in image intensifiers, vidicon television camera tubes, for various components of vacuum electron tubes and even for kinescopes when the formation of a layer of barium on the inner surfaces must be absolutely avoided, as well as on deflectors or baffles or turbomolecular pumps, and also for electrodes and components associated with ion pumps.

The getter material in suspension comprises at least one powder of a metal or of a metal alloy or of their hydrides or of a mixture of these components. If it is desired to use a metal or metal hydride as the getter material then it is preferably chosen from the group consisting of Zr, Ta, Hf, Nb, Ti, Th and uranium or a hydride thereof or a mixture thereof. The more preferred getter materials are Ti and Zr and more preferably their hydrides.

The antisintering agent in suspension may, for example, be graphite or refractory metal such as W, Mo, Nb and Ta. If it is desired to use an antisintering agent which also has gettering properties it is preferable to use a getter metal alloy. One preferred binary alloy with these properties is a Zr-Al alloy comprising from 5 to 30% wt of Al (balance Zr). The more preferred Zr-Al alloy is an alloy having 84% wt of Zr and 16% wt of Al. Other binary alloys suitable for use in the process of the present invention are, for example, Zr-Ni alloys or Zr-Fe alloys. Ternary alloys can also be used such as Zr-Ti-Fe alloys or preferably Zr-$M_1$-$M_2$ alloys, which $M_1$ is a metal chosen from the group: vanadium and nobium, and $M_2$ is a metal chosen from the group: nickel and iron. The most preferred ternary alloy is a Zr-V-Fe alloy.

It has been found that if the particles of the components in suspension have a particle size greater than about 100 $\mu$ then they are not capable of being deposited electrophoretically whereas if the particle size is too small then it is not possible to form a porous coating. The powders should therefore have a particle size less than about 100 $\mu$ and preferably less than about 60 $\mu$. Preferably they should have a particle size greater than about 20 $\mu$ and have an average particle size of about 40 $\mu$.

When the getter material (first powder) is deposited electrophoretically together with the antisintering agent (second powder), the weight ratio of the first powder to the second powder can have any desired value.

However the preferred ratio of getter material to antisintering material is between 5:1 and 1:4 and the more preferred ratio is between 3.5:1 and 2:1.

The liquid in which the getter material and antisintering agent is suspended is any liquid from which the getter material and antisintering agent may be electrophoretically deposited. It preferably comprises water and more preferably distilled water in which there has been dissolved a water miscible organic compound.

Suitable organic compounds are liquid organic compounds or their mixtures, such as alcohols, ketones or esters, and especially alkanols. For the electrophoretic deposition of getter materials the preferred organic compound is ethyl alcohol, as it is not toxic and is not flammable when mixed with water. The weight ratio between water and organic compound is any ratio which permits the electrophoretic deposition of powdered getter materials and antisintering agents suspended in the mixture. However the volume ratio of water to organic compound is preferably in the range from 3:1 to 1:3. The most preferred ratios are from 1:1 to 1:2.5.

It is convenient to add a "binder" to the water organic compound mixture. The binder performs two functions: firstly it helps to maintain the getter material powders in suspension and secondly it provides a more cohesive deposit. It may be added to the liquid in an amount up to 15% by volume and preferably not more than 5%.

In the suspension the weight ratio of solids to liquids is preferably between 3:1 and 1:2 and more preferably between 2:1 and 1:1. Any binder capable of performing the above functions may be used However a suitable binder has been found to be a solution of aluminium hydroxide in water which may be suitably prepared by dissolving aluminium turnings in a solution of aluminium nitrate according to methods well known in the art. A further advantage of using this binder is that it provides an acid solution having a value of pH between about 3 and 4 which ensures a sufficiently high and constant deposition rate of the materials in suspension upon the support when it is attached to the negative electrode of the power supply of the electrophoretic deposition apparatus.

To deposit a coating on the support it is immersed in a bath containing the materials in liquid suspension and a direct electric current is passed between the getter support as a first electrode and a second electrode which is held at a positive potential with respect to the support. It is found that the potential that need be applied is no more than about 60 V. At a potential greater than about 60 V, hydrogen starts to evolve at the electrode where the materials are being deposited. This evolution of hydrogen is highly undesirable as it interferes with the deposition process and produces a layer of deposited materials which is not sufficiently adherent to the support. Furthermore the electrophoretic deposition current is used more for the production of hydrogen than for the deposit with a subsequent reduction in the efficiency of the deposition process. The presence of hydrogen is also dangerous as it may react in an explosive manner with the atmosphere.

At potentials less than about 10 V excessively long times are required to deposit a sufficiently thick coating of the getter material and antisintering agent on the substrate. Furthermore control of the deposition process becomes more difficult as it is found that the deposit becomes less uniform in thickness. It is found that in general potentials of about 30 V for times of about 15 sec. are sufficient to give a satisfactory porous deposit of non-evaporable getter materials and antisintering agent.

When sufficient getter material and antisintering agent have been deposited the power supply is switched off and the getter support with its coating is removed from the electrophoretic deposition bath.

It is then preferable to rinse the getter device in an organic solvent such as diethyl ether or acetone to remove any loose particles of getter material or antisintering agent which could adhere to the surface of the deposit. In addition this removes any moisture from the getter device which is then dried in warm air after which it is placed in a vacuum oven. The coating of non-evaporable getter material is then sintered by means of induction heating at a temperature less than about 1100° C. and at a pressure less than about $10^{-3}$ Torr ($10^{-1}$ Pa) and preferably less than about $10^{-5}$ Torr ($10^{-3}$ Pa) The temperature is preferably in the range of about 850° C. to about 1000° C. The getter device is then allowed to cool to room temperature after which it is removed from the vacuum oven and is ready for use.

By sintering is meant, herein, the heating of the deposited particle layer for a time at a temperature sufficient to cause adhesion of the particles between themselves but not sufficient to cause a significant reduction of the free surface. It has been found that in order to obtain a deposited layer of maximum porosity the heating should take place following a suitable cycle which comprises the following steps: 1) rapid heating to a temperature of greater than 350° C. and less than 450° C. in a time of about 1 min., 2) maintenance of this temperature for about 15 min., so as to free all hydrogen from the hydride with an evolution such as to ensure a good porosity of the final product, without however being so violent as to provoke loss of adherence of the particles or to cause a plasma discharge near the getter device, 3) successively increasing the temperature up to about 930° C. in a time of about 2 min., 4) maintaining that temperature for about 5 min. for the final sintering, 5) free cooling by radiation within the switched off oven from which the getter is removed when its temperature is no greater than 50° C.

EXAMPLE 1

In a one liter plastic bottle were place 250 $cm^3$ of distilled water and 250 $cm^3$ of ethanol. 450 g of titanium hydride having particle size of less than 60 $\mu$ (Degussa) were added together with 166 g of an alloy of 84% Zr balance Al having a particle size of less than 54 $\mu$. 15 $cm^3$ of "wet binder" were then added and the plastic bottle was then sealed and agitated mechanically for a period of more than four hours. The suspension is now ready for use but if it is stored for any period of time before use it must then be reagitated for a period of at least two hours before use.

DETAILED DESCRIPTION OF THE DRAWINGS

In order to deposit, simultaneously, getter material and antisintering agent electrophoretically from the suspension an electrophoretic apparatus 10 is used as shown diagramatically in FIG. 1. Apparatus 10 comprises a glass beaker 12 in which is placed a magnetic stirring element 14 and an electrode 16 which is a hollow cylinder of steel having a diameter of 7 cm and a thickness of about 2 mm and a height of 8.5 cm. Electrode 16 is suspended centrally within beaker 12 by means of small hooks 18, 18'. A freshly agitated suspension 20 prepared as described above was poured into the beaker until electrode 16 was covered to a height of about 2 cm and the positive electrode of a power supply 22 was connected to electrode 16 by means of wire 24 connected to small hook 18'. The negative electrode of power supply 22 was connected to a getter support 24 by means of a second wire 26. Although FIG. 1 shows the getter support in the form of a hollow cylinder, for the present example there was used a getter support in the form of a strip of stainless steel having a thickness of 0.094 mm (0.0037 inches). The strip of steel held by wire 26 was placed along the axis of electrode 16 within the suspension 20.

The magnetic stirring element 14 was stopped and a potential of 30 V was applied between the steel strip and electrode 16 for a period of 20 sec.

The strip was removed from the suspension and removed from wire 26, thoroughly rinsed in acetone and then dried in warm air for about one half hour.

The strip coated with a mixture of titanium hydride and Zr-Al alloy was then placed in a vacuum oven where the pressure was reduced to less than $10^{-5}$ Torr ($10^{-3}$ Pa) and its temperature was slowly increased up to 930° C. in a period of about 20 min. However, during the increase of temperature, when this had reached 400° C., this temperature was maintained for about 15 min. so as to remove the hydrogen from the composition. When the temperature reached 900° C. this was maintained for 5 min. and then the sample was allowed to cool to room temperature.

The coated strip was removed from the vaccum oven.

Figure 2:
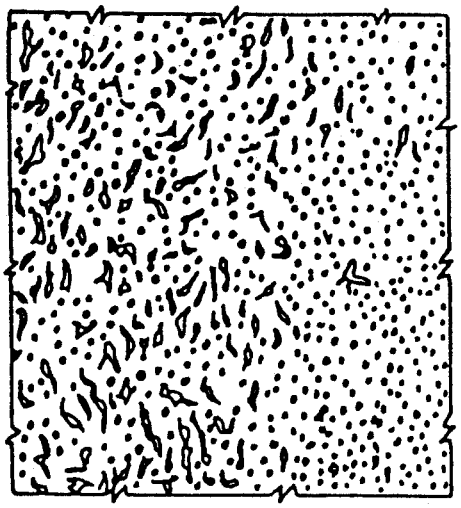
FIG. 2 is a scanning electron microscope photomicrograph of the surface of a getter device produced according to the method of the present invention before having been submitted to the sintering process.
Figure 3:
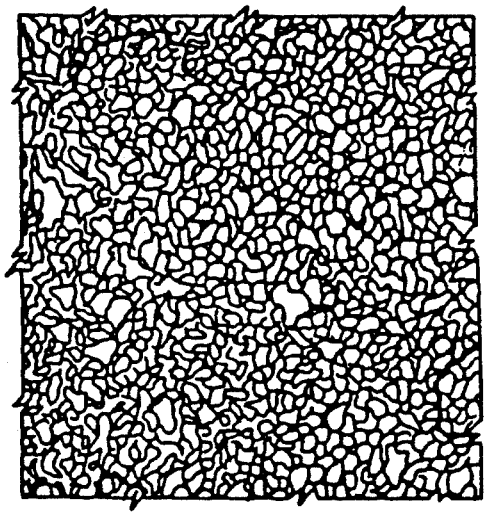
FIG. 3 is an enlargement of a portion of the surface shown in FIG. 2.
Figure 4:
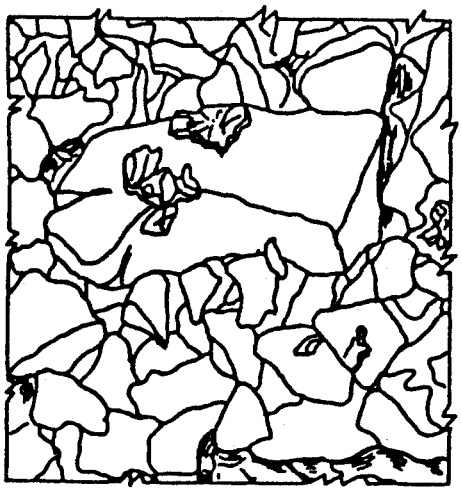
FIG. 4 is a further enlargement of the portion of the surface shown in FIG. 3.

FIGS. 2, 3 and 4 are scanning electron microscope photomicrographs of the surface of the electrophoretically coated strip of stainless steel at magnification of 16×, 400× and 1800× respectively. These photomicrographs were taken before the electrophoretically deposited layer had been subjected to the vacuum heat treatment and therefore before sintering.

Figure 5:
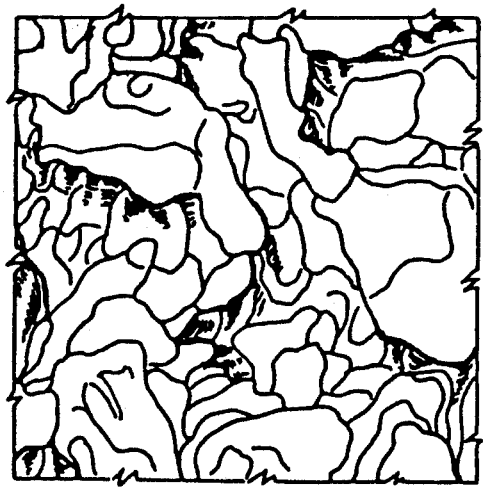
FIG. 5 is an enlargement of a portion of the surface shown in FIG. 2, but after the getter device has been submitted to the sintering process.

FIG. 5 is an additional scanning electron microscope photomicrograph of the surface after the coated strip had been subjected to the vacuum heat treatment as described. This photomicrograph, having a magnification of 3000×, clearly shows that the heat treatment does not provoke any significant reduction in the porosity of the open structure of the deposited coating.

EXAMPLE 2

A cylindrical getter support was manufactured from a 1 cm wide stainless steel strip having a thickness of 0.094 mm (0.0037 inches). The procedure of example 1 was followed exactly with the sole difference that the getter support was replaced by the cylindrical getter support. A number of these cylindrical getter devices, electrophoretically coated with a mixture of titanium hydride and zirconium-aluminium alloy and subjected to the vacuum sintering process, were produced and subjected to gas sorption tests. The results of the gas sorption tests are reported in the curves of FIGS. 6 and 7.

EXAMPLE 3

This comparative Example was performed in order to compare the properties of a prior art getter with those of the present invention. Getter pellets were obtained which had been manufactured by the compression of a mixture of powders of titanium and a Zr-Al alloy. The pellets comprise a circular steel holder with an opening at one side having a diameter of 4 mm and an opening at the other side having a diameter of 5.5 mm. The pellet height was 4.3 mm. These pellets were subjected to the same gas sorption tests as the getter devices of Example 2. The gas sorption test results are reported for comparison on the graphs of FIGS. 6 and 7.

Discussion of gas sorption test results

Figure 6A:
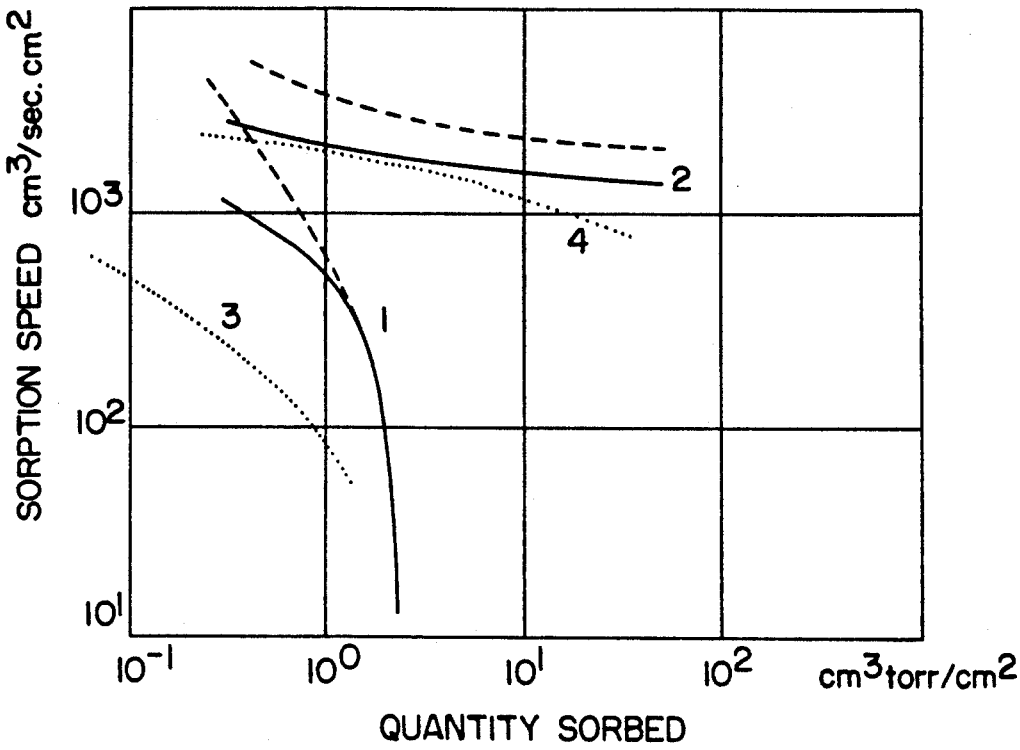
FIGS. 6 and 7 are graphs comparing the sorption characteristics, for hydrogen and carbon monoxide, of getter devices produced according to the present invention with those produced according to traditional techniques.

FIG. 6 reports sorption speed of the getter devices as a function of the quantity of gas sorbed after an activation at 900° C. for 10 min. The pressure of the gas being sorbed above the getter device is held constant at $3\times10^{-6}$ Torr ($4\times10^{-4}$ Pa). Curve 1 is the gas sorption characteristic for the gas CO for a getter device of the present invention, manufactured as described in Example 2. Curve 2 is the sorption characteristic obtained by a getter device of the present invention when the gas being sorbed is $H_2$. The dashed lines near curves 1 and 2 are the sorption curves which would have been obtained if the gas inlet flow conductance had not limited the rate of flow of gas into the getter sample test chamber. Curve 3 represents the gas sorption characteristic for CO of a traditional getter device of Example 3. Curve 4 is the sorption characteristic of a traditional getter device obtained when the gas being sorbed was $H_2$.

Figure 7:
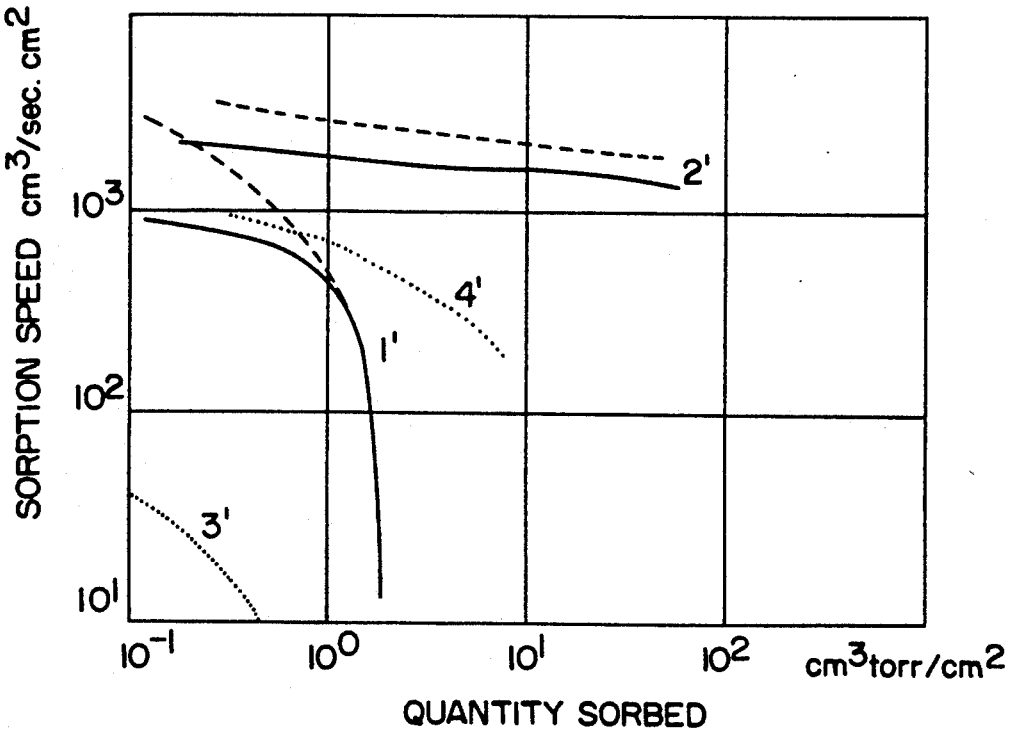

FIG. 7 shows the sorption characteristic when the temperature of activation of the getter device was 500° C. for 10 min. Curves 1' and 2' refer to getter devices of the present invention for the gases CO and $H_2$ respectively whereas the curves 3' and 4' refer again for CO and $H_2$ respectively.

It can be seen that the sorption characteristics the getter devices of the present invention are vastly superior to those of traditional getter devices.

What is claimed is:

1. A method for manufacturing a porous non-evaporable getter device comprising the steps of:
   A. immersing a metallic getter support in a suspension comprising a mixture of particles of:
      1. titanium hydride having a particle size less than 60 μ and greater than 20 μ and having an average particle size of 40 μ; and
      2. a Zr-based alloy having a particle size less than 60 μ and greater than 20 μ and an average particle size of 40 μ, in which the weight ratio of 1. to 2. is between 3.5:1 and 2:1, in a liquid comprising:
      a) distilled water
      b) ethyl alcohol and
      c) a solution of Al hydroxide in water in which the volume ratio a):b) is between 1:1 and 1:2 the percentage by volume of c) with respect to a) plus b) is less than 5% and the weight ratio of solids to liquids is between 2:1 and 1:1;
   B. passing a direct electric current between the metallic getter support as a first electrode and a second electrode the latter having a potential not greater that 60 V with respect to the metallic getter support for a time no greater than 60 sec., so depositing a porous coating of a mixture of particle's of titanium hydride and the Zr-based alloy on the metallic getter support;
   C. removing the coated metallic getter support from the suspension;
   D. drying the coated metallic getter support; and
   E. rapidly heating the coated metallic getter support at a pressure less than $10^{-5}$ Torr ($10^{-3}$ Pa) to a temperature between 350° C. and 450° C., maintaining this temperature until all the hydrogen has been released from the titanium hydride and then heating to a temperature between 900° C. and 1000° C/ for sintering, cooling to a temperature below 50° C.

2. A method according to claim 1 in which said Zr-based alloy is a Zr-Al binary all having 84% wt of Zr and the balance Al.

3. A method according to claim 1 in which said is the ternary alloy Zr-V-Fe.

4. A method of manufacturing a porous, non-evaporable getter device comprising the steps of:
   I. immersing a stainless steel getter support in a suspension, said suspension consisting essentially of:
      A. titanium hydride having a particle size of less than 60 μ and greater than 20 μ with an average particle size of 40 μ;
      B. a Zr-Al alloy comprising 84% Zr and 16% Al, said Zr-AL alloy having a particle size of less than 60 μ and greater than 20 μ with an average particle size of 40 μ;

C. water;

D. ethyl alcohol; and

E. aluminium hydroxide;

wherein, the weight ratio of A:B is between 3.5:1 and 2:1; and wherein, the volume ratio of C:D is between 1:1 and 2:1; and wherein, the volume of E is less than 5% of the total volume of C and D; and wherein, the weight ratio of solids to liquids in said suspension is between 2:1 and 1:1; and then II. applying a potential of 20 to 40 volts between said getter support as a first electrode and a second electrode for a time of 15 seconds to 25 seconds thereby depositing a porous coating of a mixture of titanium hydride and Zr-Al alloy on the getter support to produce a coated support; and then III. removing the coated support from the suspension; and then IV. rinsing the coated support with acetone; and then V. drying the coated support; and then VI. heating the coated support at a pressure less than $10^{-5}$ Torr ($10^{-3}$ Pa) to a temperature between 350° C. and 450° C.; and then VII. maintaining the coated support at a pressure less than $10^{-5}$ Torr ($10^{-3}$ Pa) and at a temperature between 350° C. and 450° C. for a period of time sufficient to release all hydrogen from the titanium hydride thereby converting the titanium hydride to metallic titanium; and then VIII. sintering the coated support at a temperature between 900° C. and 1000° C. to produce the porous, non-evaporable getter device; and then IX. cooling said getter device to room temperature.

* * * * *